United States Patent [19]

Retz

[11] Patent Number: 4,501,327

[45] Date of Patent: Feb. 26, 1985

[54] SPLIT CASING BLOCK-OFF FOR GAS OR WATER IN OIL DRILLING

[76] Inventor: Philip Retz, 1783 Lanier Pl., NW., Washington, D.C. 20009

[21] Appl. No.: 487,238

[22] Filed: Apr. 27, 1983

Related U.S. Application Data

[63] Continuation-in-part of Ser. No. 399,259, Jul. 19, 1982, abandoned.

[51] Int. Cl.[3] ..... E21B 43/10

[52] U.S. Cl. ..... 166/285; 138/98; 166/277; 166/387

[58] Field of Search ..... 166/242, 285, 277, 387, 166/72, 207, 206, 287, 297, 55, 55.1, 65 M; 138/98; 98X; 137/15; 175/72; 411/60, 61, 19, 521, 20; 72/120; 29/234, 235, 278; 254/134.4; 269/48.1; 405/133

[56] References Cited

U.S. PATENT DOCUMENTS

| | | | |
|---|---|---|---|
| 341,327 | 5/1886 | Fay | 405/133 X |
| 958,517 | 5/1910 | Mettler | 166/207 X |
| 2,214,226 | 9/1940 | English | 166/277 |
| 2,245,712 | 6/1941 | Ragan | 166/65 M |
| 2,556,672 | 6/1951 | Bergh et al. | 411/20 X |
| 2,575,938 | 11/1951 | Benneke | 72/120 X |
| 3,000,443 | 9/1961 | Thompson | 166/119 X |
| 3,167,122 | 1/1965 | Lang | 166/277 |
| 3,191,677 | 6/1965 | Kinley | 166/277 |
| 3,354,955 | 11/1967 | Berry | 166/277 |
| 3,557,876 | 1/1971 | Tragesser | 175/72 X |
| 3,948,321 | 4/1976 | Owen et al. | 166/277 |
| 4,109,684 | 8/1978 | Fernandez | 138/97 |
| 4,155,404 | 5/1979 | Hollingsworth | 166/242 X |

FOREIGN PATENT DOCUMENTS

| | | | |
|---|---|---|---|
| 736288 | 6/1966 | Canada | 166/207 |

*Primary Examiner*—George A. Suchfield
*Assistant Examiner*—Michael Starinsky
*Attorney, Agent, or Firm*—Saidman, Sterne, Kessler & Goldstein

[57] ABSTRACT

A method for sealing the wall of a bore hole comprises forming a liner of resilient sheet material into a substantially cylindrical or scroll configuration having a diameter smaller than that of the hole, inserting the liner into the hole, allowing the liner to expand to substantially the diameter of the hole, and pressing the liner against the wall of the bore hole. Apparatus for performing the method comprises an elongated member having a first end insertable into the bore hole, means associated therewith for supporting a liner within the hole, and rotary means for pressing the liner into contact with the wall of the hole. A liner in accordance with the present invention comprises a resilient sheet pressed against the wall of the bore hole, and a layer of mud and cement interposed between the sheet and the wall.

39 Claims, 5 Drawing Figures

SPLIT CASING BLOCK-OFF FOR GAS OR WATER IN OIL DRILLING

This application is a continuation-in-part, of application Ser. No. 399,259, filed July 19, 1982, now abandoned

BACKGROUND OF THE INVENTION

1. Field of the Invention

This invention relates to a method and apparatus for applying a split casing liner to the wall of a bore hole. The invention also relates to a split casing or liner suitable for sealing a portion of the wall of a bore hole.

2. Discussion of Related Art

Considerable time is lost when water or gas is struck while drilling for oil. Water, gas, or even oil might be found in the earth at a level above that level at which oil is expected to be found. Once the drill penetrates the stratum of the earth containing the water or gas, the water or gas is likely to seep into the bore hole through the wall thereof. This phenomenon is undesirable as the fluid seeping into the hole may interfere with the drilling process. Also, it may be desirable to conserve the gas, water or oil for recovery at a later time. For these reasons, it is often desired to seal the wall of the bore hole in regions where seepage occurs.

Various devices and methods have been employed to secure liners within subterranean bore holes. Many methods for doing so involve the use of explosives.

U.S. Pat. No. 2,214,226 to English discloses a technique for explosively expanding a deformable liner into contact with the wall of a bore hole. Alternatively, the technique and apparatus of the reference may be used to repair a casing previously installed within the hole. A liner having a diameter somewhat smaller than that of the casing or bore hole is inserted therein, and an explosive charge is detonated within the liner. The resulting force plastically deforms the liner in the region of the explosion, causing it to expand outwardly into contact with the casing or bore hole. However, the remaining portions of the liner retain its original, relatively small diameter, necessitating the use of a smaller drill bit following installation of the liner. Similarly, Lang, U.S. Pat. No. 3,167,122, discloses a radially crimped liner, expanded by explosive force and including a resilient sealing layer between the liner and a casing to be repaired. The method disclosed in this reference also comprises a subsequent deformation step to assure that the liner is fully expanded into contact with the casing.

Kinley, U.S. Pat. No. 3,191,677 dislcoses a method employing repeated explosions to drive an expander unit through a liner. Portions of the apparatus must be repeatedly withdrawn from the bore hole to be reloaded for successive detonations. U.S. Pat. No. 3,948,321 to Owen et al. uses explosive force for driving frustoconical wedges into a tubular liner, thus wedging the liner within a well casing.

It is, at best, extremely difficult to assure that a smooth and reliable seal will be achieved by any of the above methods utilizing explosives, as the forces involved are extremely difficult to control or regulate with any degree of accuracy.

U.S. Pat. No. 3,354,955 to Berry discloses a resilient liner for temporarily sealing openings in a well casing. The liner is inserted into the bore hold in a crimped condition, and is allowed to expand into contact with the casing. The device and method of this patent does not effect a reliable permanent seal of the casing, nor is it intended to do so.

Russian disclosure No. 588,346 illustrates a resilient helical steel strip wrapped tightly about a mandrel for repairing the wall of a bore hole. A second strip seals the seam between adjacent wraps of the helix. The device is inserted into a bore hole, and the strips are allowed to expand into contact with the walls thereof. The device apparently comprises no means for reliably securing it to the wall.

OBJECTS OF THE INVENTION

Accordingly, it is an object of the present invention to provide a method and apparatus for lining or sealing a bore hole which overcomes the drawbacks associated with prior art techniques and devices.

It is an object of the present invention to provide a method for sealing or repairing a bore hole wall by securely affixing a liner thereto.

It is an object of the present invention to provide such a method which may be performed with minimum manipulation of drilling equipment.

It is a further object of the present invention to provide improved apparatus for applying a liner or split casing to the wall of a bore hole.

It is an object of the present invention to provide such apparatus which, other than a split casing applied to a bore hole, is reusable, thus minimizing the cost associated therewith.

It is a further object of the present invention to provide a liner in the form of a split casing capable of positively and permanently sealing the wall of a bore hole.

It is still another object of the present invention to provide a split casing liner for a bore hole which, when applied to the wall, is of substantially the same diameter as the hole, and thus does not interfere with subsequent drilling procedures.

SUMMARY OF THE INVENTION

The present invention includes a method for sealing the wall of a bore hole, the hole having a predetermined diameter, the method comprising the steps of forming a liner of resilient sheet material into a scroll having a smaller diameter than the predetermined diameter, inserting the liner into the bore hole, allowing the scroll to expand whereby its diameter is increased to substantially the predetermined diameter, and pressing the liner against the wall of the bore hole. The step of forming the liner comprises providing a substantially rectangular liner of resilient sheet material, rolling the liner into a scroll having a smaller diameter than the predetermined diameter, opposite edge portions of the liner overlapping each other along a portion of the scroll substantially parallel to the axis thereof, and retaining the liner in the scroll of the smaller diameter. The rectangular liner has at least one dimension which is at least as great as the circumference of the bore hole, wherein the rolling step comprises rolling the liner into a scroll with the one dimension oriented in a direction substantially perpendicular to the axis of the scroll.

In a preferred embodiment, the present invention includes the further step of applying a layer of mud to the exterior surface of the scroll prior to inserting it into the bore hole. Also, a layer of cement, preferably dry Portland cement, may be applied to the layer of mud prior to inserting the scroll into the hole.

In another of its aspects, the present invention comprises a method for sealing the wall of a bore hole, the hole having a predetermined diameter, the method comprising the steps of forming a resilient liner substantially into a cylinder having a smaller diameter than the predetermined diameter, applying a layer of mud and a layer of cement to the exterior of the liner, inserting the liner into the bore hole, allowing the liner to expand into contact with the wall of the bore hole whereby its diameter is increased to substantially the predetermined diameter, and pressing the liner against the wall of the bore hole. The step of forming a liner comprises forming a liner of resilient sheet material into the cylinder wherein the resilient material is biased in a direction tending to enlarge the diameter of the cylinder, and retaining the liner in the form of the cylinder of smaller diameter.

The pressing step of the method of the present invention comprises contacting pressing means with the liner and moving the pressing means circumferentially of the liner and the wall of the bore hole. Particularly, the pressing step may comprise contacting rotary pressing means with the liner and rotating the pressing means.

The present invention also comprises a liner for a bore hole comprising a resilient sheet pressed against the wall of the bore hole, and a layer of mud and cement interposed between the sheet and the wall. The bore hole has a predetermined diameter and circumference, the liner comprising a resilient sheet having at least one dimension which is at least as great as the predetermined circumference, and the sheet is pressed against the wall of the bore hole about the entire circumference thereof. The sheet forms a substantially cylindrical surface, and may further comprise outwardly beveled portions at the axial ends of the cylindrical surface.

Means are provided for retaining the sheet in a substantially cylindrical configuration having a diameter smaller than the predetermined diameter prior to the application of the sheet to the wall of the bore hole, and means are provided for releasing the sheet to allow it to expand to the predetermined diameter.

In another of its aspects, the present invention includes apparatus for lining a bore hole comprising an elongated member having a first end thereof adapted to be inserted into the bore hole, means associated with the first end for supporting a liner within the bore hole, and rotary means for pressing the liner into contact with the wall of the bore hole. The liner comprises resilient material; and the apparatus further comprises means for retaining the liner in a substantially cylindrical configuration having a diameter smaller than the diameter of the bore hole, and means for releasing the liner, allowing it to expand into contact with the wall of the hole. The retaining means may comprise at least one fastener, and the releasing means may comprise means for rupturing or relasing the fastener. In a preferred embodiment, the rupturing means is an explosive device. In another preferred embodiment, the releasing means is non-explosive, and comprises, for example, releasable knots.

The rotary means comprises at least one element for pressing the liner into contact with the wall of the hole, and means for driving the rotary means in rotation about an axis generally parallel to the axis of the bore hole. The rotary means also comprises means for retracting the element and for expanding the elements to press the liner into contact with the wall of the bore hole. In a preferred embodiment the elements comprise displaceable members having first and second ends, the rotary means further comprising means for mounting the first ends of the displaceable members thereto at a fixed position on the rotary means, and means for moving the second ends toward and away from the first ends to expand and retract the elements. The means for moving the second ends may comprise a solenoid. It may also comprise a weight biasing the elements into engagement with the liner.

The elongated member of the present invention comprises a second end, and means are associated with the second end of the elongated member for driving the elongated member and the rotary means in rotation.

The invention further comprises means associated with the first end of the elongated member for blocking flow through the bore hole. Such means comprises a sealing member having a diameter substantially equal to the diameter of the bore hole.

The invention may also comprise means for applying lubricating mud to the liner. The lubricating means may be associated with the flow blocking means.

BRIEF DESCRIPTION OF THE DRAWINGS

The above objects and features may be best understood by reference to the following description of a preferred embodiment considered in conjunction with the accompanying drawings in which.

DETAILED DESCRIPTION OF THE PREFERRED EMBODIMENT

Figure 1:
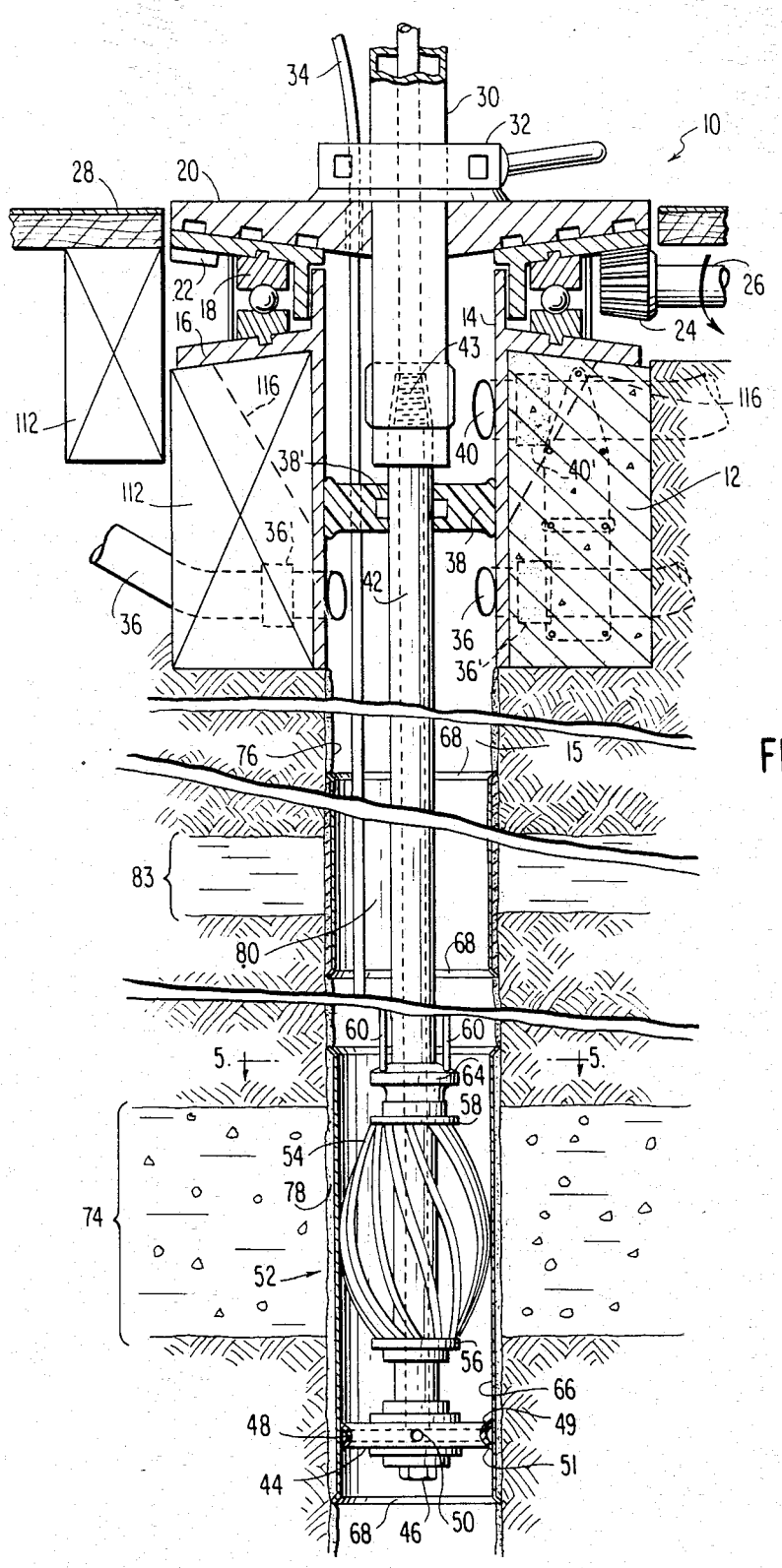
FIG. 1 illustrates a preferred embodiment of apparatus in accordance with the present invention, associated with certain elements of a conventional drill rig, pressing a liner to a bore hole wall.

FIG. 1 illustrates a well head designated generally by reference numeral 10. Head 10, which, for convenience of illustration, is shown as being located on inclined terrain, includes a support or footing 12, formed, for example, of concrete or the like on one side thereof and support members 112 formed, for example, from wood on the other side thereof. If head 10 is to be above ground surface it may be supported entirely by members 112. Supporting head 10 in this manner keeps overflow from the well away from the work platform 28 and permits access to head 10 for servicing below platform 28.

A tubular member 14 forms an entrance to a bore hole 15 drilled by well head 10. A flange 16 of member 14 is braced by a plurality of braces 116 and supports a bearing assembly 18. Bearing 18 rotatably supports a rotor 20 having a rackgear 22 associated therewith. Rack 22 engages a pinion 24 on the end of a shaft 26. Rotation of shaft 26 as indicated in FIG. 1 thus rotates rotor 20 in a clockwise direction, as viewed from above. Platform 28 surrounds rotor 20.

A kelly 30 is secured to rotor 20 by a collar 32, and is rotatably driven thereby. The present apparatus includes an electrical control cable 34 extending through collar 30 and rotor 20, for a purpose to be described in greater detail hereinafter.

During normal drilling operation, a fluid, commonly called mud, is pumped into the bore hole through the drill string. The mud flows through the drill bit, and back up through the bore hole around the outside of the drill string carrying with it cuttings from the drill bit. A pair of conduits 36 including couplings 36' return the mud to a screening or inspection area (not shown) where the cuttings may be inspected to determine the nature of the formations encountered by the drill bit. A plug 38 prevents flow of mud into the area of bearing 18, rotor 20, etc. A safety conduit 40 including coupling 40' permits any mud or gas which seeps past plug 38 to be safely removed from the apparatus. Plug 38 is clamped to member 42, described in greater detail hereinafter, by a clamp illustrated schematically at 38' and rotates with the drill string.

Figure 2:
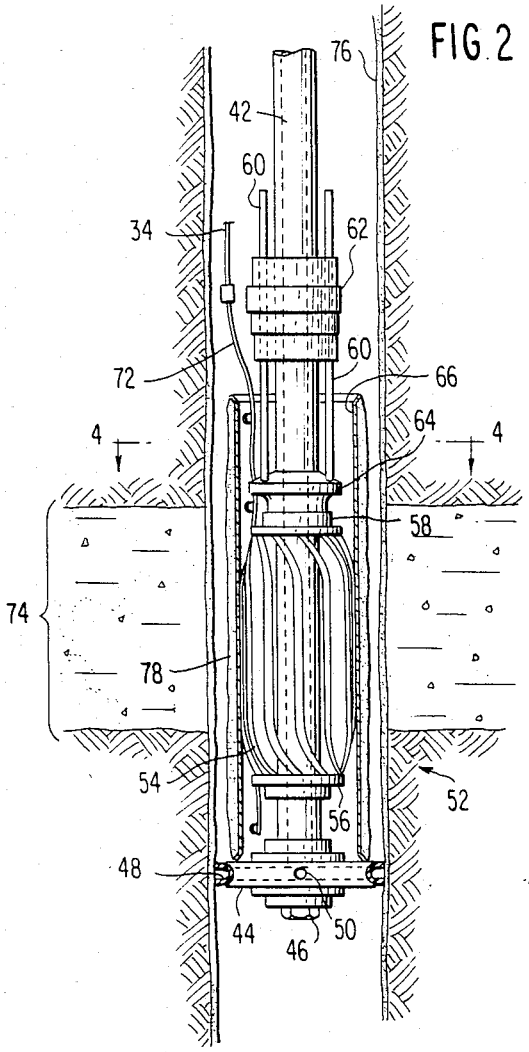
FIG. 2 illustrates a portion of the apparatus of FIG. 1 prior to the pressing step of the method of the present invention.

Referring to FIGS. 1 and 2, the apparatus of the present invention comprises an elongated hollow member or pipe 42 coupled to kelly 30 by a coupling 43 to be driven in rotation by kelly 30. A disc member 44 is positioned at an end of elongated member 42 opposite coupling 43, and is secured thereto by, for example, a nut 46. Secured about the periphery of disc 44 is a sealing member 48 comprising a pair of resilient lips 49 and 51. In their relaxed state, lips 49 and 51 have a diameter substantially equal to or slightly greater than the diameter of the bore hole. A plurality of apertures 50 extend from the region between lips 49 and 51 and the interior of elongated hollow member 42. Disc 44 and sealing member 48 comprise which is commonly known as a squeegee. This and apertures 50 are provided for a purpose to be described in greater detail hereinafter.

The rotary pressing means of the present invention is generally designated by reference numeral 52 in FIGS. 1 and 2. Pressing means 52 includes a plurality of pressing elements 54, here illustrated as flexible bands or strips which may be formed of, for example, spring steel. One end of each of elements 54 is secured to a stationary mount 56, while the other end of each element 54 is secured to a movable mount 58. Mount 58 is movable axially of elongated member 42, toward and away from stationary mount 56. When movable mount 58 moves toward mount 56, elements 54 tend to flex outwardly, expanding pressing means 52. Movement of mount 58 away from mount 56 causes elements 54 to be retracted, reducing the overall diameter of pressing means 52.

A plurality of push rods 60 are associated with movable mount 58 for moving the same toward and away from stationary mount 56. A stationary collar 62 is affixed to elongated member 42 and includes means for effecting movement of push rods 60. Such means may include, for example, solenoids or hydraulic or pneumatic means (not shown) associated with each rod 60 for axially moving the same, and thus movable mount 58. The solenoids may be operated through cable 34. Alternatively, cable 34 may include a conduit for control fluid if hydraulic or pneumatic means is used. A weight 64 may be associated with movable mount 58 for biasing pressing means 52 into a position wherein elements 54 are extended outwardly.

Figure 3:
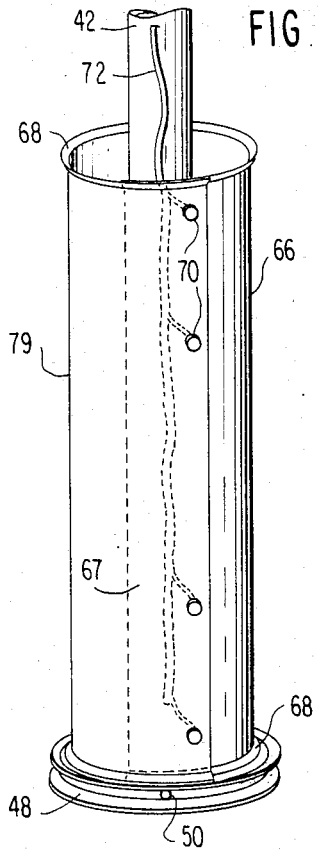
FIG. 3 shows a liner in accordance with the present invention prior to insertion into a bore hole.

As best seen in FIG. 3, a liner 66 in accordance with the present invention comprises a sheet of resilient flexible material, such as spring steel or aluminum. When rolled to form a cylinder and installed in a bore hole, in a manner to be described in greater detail hereinafter, the liner forms a split casing within the bore hole. A suitable thickness for the liner is approximately 3/64 inch, although thicker or thinner materials may be used as requirements dictate. Preferably, a pair of beveled edges 68 are formed along opposite portions of liner 66. When liner 66 is formed into a substantially cylindrical configuration, as illustrated, edges 68 are beveled outwardly from the endmost circumferential portions of the cylinder. A plurality of releasable fasteners 70 are provided for retaining liner 66 in the cylindrical configuration illustrated.

Figure 4:
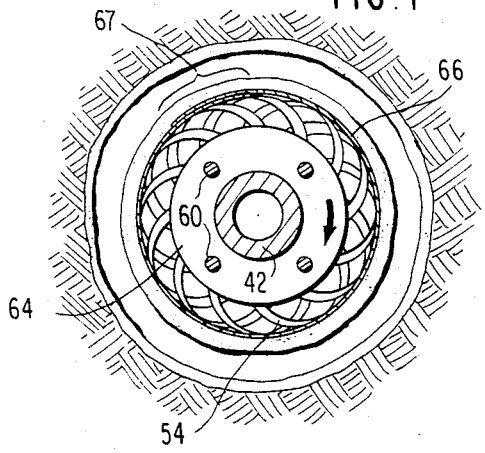
FIG. 4 is a sectional view along line 4—4 of FIG 2.
Figure 5:
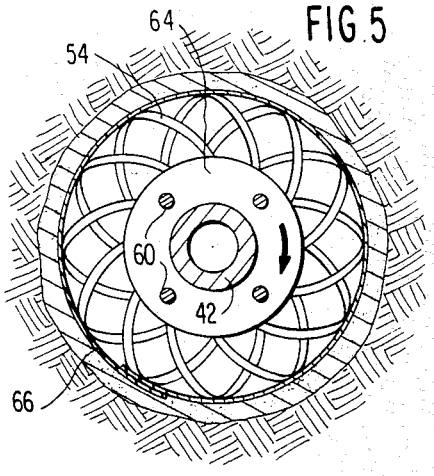
FIG. 5 is a sectional view along line 5—5 of FIG. 1.

When installed in bore hole 15, liner 66 must have a circumferential dimension at least substantially as great as the circumference of hole 15 in order to fully seal the periphery thereof. Also, in order to insert liner 66 into hole 15, liner 66 must be formed into a cylinder having a diameter smaller than that of hole 15, as will be described more fully below. Therefore, it is necessary to overlap at least a portion of liner 66 with other portions thereof, forming an overlap region 67, as best seen in FIGS. 3 and 4. Thus, the configuration of liner 66 prior to installation in hole 15, while substantially a cylinder, may be more accurately described as a cylindrical scroll.

During drilling of, for example, an oil well, bore hole 15 will pass through numerous strata lying below the earth's surface. One or more of these strata, for example stratum 74, may contain significant quantities of water or natural gas. During drilling, significant quantities of this water or gas may seep into hole 15, interfering with the drilling process and possibly wasting such water or gas which might desirably be conserved for recovery at a later time. It is therefore necessary to seal the wall of hole 15 in the region of stratum 74. It will be necessary to withdraw the drill string in order to seal the appropriate portion of bore hole 15. Information derived from geological studies and surveys will indicate with sufficient accuracy the level and thickness of the layer to be sealed.

If necessary, the apparatus in accordance with the present invention may be used to remove fluids from bore hole 15. The electrically or fluid operated actuator means associated with collar 62 are activated to move push rods 60 and movable mount 58 upwardly, retracting elements 54. With elements 54 in this position, the apparatus may be freely inserted into bore hole 15.

Sealing member 48 is inserted to a depth below stratum 74. The diameter of member 48 is sufficiently large to block flow through hole 15 and prevent seeping fluid from filling the hole. By lifting or removing kelly 30, rotor 20 and plug 38, a hose may be dropped into the hole, for withdrawing the accumulated fluid therefrom. Once the fluid is substantially all removed, the apparatus is withdrawn.

The squeegee comprising disc 44 and sealing member 48 may also be used to clean the interior of bore hole 15. In inserting and withdrawing the apparatus, member 48 removes a substantial portion of the mud layer 76 normally adhering to the interior wall of hole 15. Additionally, cleaning action may be augmented by water fed through hollow member 42 and apertures 50. This facilitates inspection of hole 15 with electronic apparatus, if necessary.

An appropriately sized split casing liner 66 is chosen for application to the interior of hole 15. The height of liner 66 should be considerably greater than the depth of stratum 74 to be sealed while the width thereof should be sufficient to cover the entire circumference of the wall of hole 15. Liner 66 should cover the interior of hole 15 to a height approximately 2.5 feet above and approximately 3 feet below stratum 74. Assuming stratum 74 to have a height of 2.5 feet, liner 66 should have a height of approximately 8 feet. If the diameter of hole 15 is one foot, the circumference thereof will be 3.14 feet. The width of liner 66 should be at least this great, and preferably great enough that the ends thereof overlap approximately 6 inches in the installed liner. Liner 66 should thus have a width of approximately 3.64 feet.

In preparing the apparatus for installation of liner 66, the actuator means associated with the collar 62 is activated to move rods 60, movable mount 58 and weight 64 upwardly, thus retracting elements 54 to the positions illustrated in FIG. 2. In this position, the rotary means will occupy approximately six to eight inches of the hole diameter. Liner 66 is then rolled or formed into a cylindrical scroll about rotary means 52. Liner 66 thus surrounds means 52 and is of a smaller diameter than that of hole 15. The diameter of liner 66 in this configuration should be approximately two inches smaller than the diameter of hole 15. Releasable fasteners 70 are provided for securing liner 66 in this configuration.

Fasteners 70 may comprise, for example, explosive screws connected by leads 72 to cable 34. When positioned about rotary means 52, liner 66 rests upon disk 44 of the apparatus. In order to permanently secure liner 66 within hole 15 and to effect a reliable seal, a layer of mud 78 is applied to the exterior surface 79 of liner 66. Additionally, a heavy layer of dry cement (not shown) is applied over mud layer 78. Explosive screws must be of a length sufficient to permit liner 66 to be maintained in the scroll configuration with overlapping parts thereof spaced sufficiently from each other to allow the mud and cement layers to be applied to all outer portions of liner 66. The apparatus is then inserted into hole 15 and liner 66 is positioned adjacent stratum 74, as illustrated in FIG. 2. With liner 66 properly positioned, fasteners 70 are released, for example, by an explosion detonated through leads 72. Fasteners 70 may be explosive screws of a known variety wherein the head of the screw is blown off by an explosive charge, whereby the screw no longer performs its fastening function.

Alternatively, fasteners 70 may comprise releasable knots, such as slip knots or bowknots. A plurality of releasable knots are provided for retaining liner 66 in a cylindrical configuration. The use of releasable knots is preferable where gas or another flammable substance is present or suspected, and the use of explosive screws creates a risk of fire or explosion.

As previously described, a layer of mud and dry cement are applied to the exterior surface 79 of liner 66, and the liner is rolled or formed into a cylindrical scroll about rotary means 52 resting on disk 44. The liner is then temporarily secured by a clamp (not shown), for example. Flexible, non-conductive line is placed over the mud and cement layer and tied at the ends by a releasable knot. The line must be of sufficient length to extend once around the circumference of liner 66 and tie a releasable knot therewith. Preferably, three such lines are used; and are placed approximately 6 inches from either end of liner 66 and in at least one intermediate position. In a preferred embodiment, the liner comprises 120 pound test woven fishing line. Woven line is preferable because it will not slip. The releasable knots are connected to each other serially, with the uppermost knot being connected to cable 34, for use in a manner to be hereinafter described in greater detail. Once liner 66 has been secured by the releasable knots, the clamp is removed.

With liner 66 positioned on disc 44, the apparatus is inserted into hole 15 and liner 66 is positioned adjacent stratum 74, as illustrated in FIG. 2. Fasteners 70 are then released by pulling on the cable, which in turn releases the knots.

Once fasteners 70 are released, liner 66 is free to expand radially outward as a result of its inherent resiliency. Liner 66 therefore expands into contact with the wall of hole 15 about the entire circumference thereof. Simultaneously, the actuator means associated with collar 62 is activated to move rods 60 and movable mount 58 downwardly, expanding elements 54 into engagement with liner 66. Weight 64 assists in this downward movement, and provides a force urging elements 54 outwardly into contact with liner 66. Kelly 30 is then driven in rotation by shaft 26, pinion 24 and rack 22, as decribed above, thereby driving elongated member 42 and rotary means 52 in rotation. Liner 66 is rolled in the direction of rotation of means 52 so that the motion of elements 54 will be in a direction tending to expand liner 66 into contact with the bore hole wall. This relationship can best be seen in FIG. 4 of the drawings.

Rotary means 52 is slowly reciprocated axially of hole 15 during rotation thereof in order to firmly press all portions of liner 66 against the hole wall. If necessary, lubricating mud may be provided to the surface of liner 66 through elongated member 42 and apertures 50 communicating with sealing member 48. Lubrication will facilitate smooth operation of rotary means 52 and prevent damage to liner 66.

Sufficient time is then allowed for the cement applied to liner 66 to begin to harden. The amount of time necessary will vary with the type of cement used. Sealing member 48 is positioned below the liner. Leaking gas may be detected by its odor and, after an appropriate length of time, a hose is dropped into hole 15 to see if fluids are leaking onto squeegee 44,48, which will retain such fluids thereabove. If no fluid is present, it may be assumed that seepage has been effectively stopped. Members 54 are then retracted by raising rods 60, weight 64 and mount 58, and the apparatus may be withdrawn and drilling resumed.

FIG. 1 illustrates a previously installed liner 80 positioned at the level of another stratum 83. Liner 80, which conforms closely to the wall of hole 15, appears in the figure to be somewhat smaller in diameter than the hole. It is illustrated in this manner only for the purpose of clearly illustrating the manner in which liner 80 is installed within the bore hole. In fact, the diameter of installed liner 80 is substantially equal to the diameter of bore hole 15. This facilitates passage of the same drilling equipment originally used to bore hole 15, and obviates the need for additional equipment of smaller diameter. Also, outwardly beveled edges 68 allow free passage of the drilling equipment, preventing such equipment from catching on liner 80.

The drilling string must be pulled from the hole only once in order to install a split casing liner in accordance with the present invention. Due to its configuration and the fact that it conforms very closely to the wall of the bore hole, the present split casing liner enables the operator to reinsert the same drilling equipment and continue to bore a hole of the originally desired diameter. Assuming that a casing is to be inserted into bore hole 15, a casing of the originally intended size may be installed and cemented throughout the entire length of hole 15. Thus, the need for multiple sizes of drill strings and casings is obviated, and the cost of drilling is substantially reduced. Additionally, by maintaining the full diameter of the bore hole throughout its entire depth, a relatively large electric pump capable of pumping as much as hundreds of gallons per minute, can be easily lowered to the bottom of the well.

In some drilling operations, the liner or split casing of the invention may be all that is necessary, eliminating the need for costly conventional casings during drilling. If the well proves to be productive, a conventional casing may then be installed.

While the invention has been disclosed with reference to the particular embodiment illustrated in the accompanying drawings, it is not to be considered as limited to the details shown therein as obvious modifications are within the scope of those or ordinary skill in the art, the invention being limited only by the claims appended hereto.

I claim as my invention:

1. A method for sealing the wall of a bore hole, the bore hole having a predetermined diameter, the method comprising the steps of:

forming a liner of resilient sheet material into a scroll having a smaller diameter than the predetermined diameter;

locating said scroll around a shaft having a squeegee at one end;

inserting said liner into the bore hole preceded by said squeegee;

allowing said scroll to expand whereby its diameter is increased to substantially the predetermined diameter; and pressing said liner against the wall of the bore hole.

2. A method for sealing the wall of a bore hole, the bore hole having a predetermined diameter, the method comprising the steps of:

forming a liner of resilient sheet material into a scroll having a smaller diameter than the predetermined diameter;

applying a layer of mud to the exterior surface of said scroll prior to inserting said scroll into the bore hole;

inserting said liner into the bore hole;

allowing said scroll to expand whereby its diameter is increased to substantially the predetermined diameter; and pressing said liner and mud layer against the wall of the bore hole whereby said layer of mud seals the wall of the bore hole.

3. A method as in claim 24, wherein said step of forming a liner comprises the steps of:

providing a substantially rectangular liner of resilient sheet material;

rolling said liner into a scroll having a smaller diameter than said predetermined diameter, opposite edge portions of said liner overlapping each other along a portion of said scroll substantially parallel to the axis thereof; and retaining said liner in said scroll of said smaller diameter.

4. A method as in claim 3, wherein said rectangular liner has at least one dimension at least as great as the circumference of the bore hole, and wherein said rolling step comprises the step of rolling said liner into a scroll with said one dimension oriented in a direction substantially perpendicular to the axis of said scroll.

5. A method as in claim 4, wherein said rectangular liner is rolled into a scroll around rotary pressing means.

6. A method as in claim 2, wherein said pressing step comprises the steps of:

contacting pressing means with said liner; and moving said pressing means circumferentially of said liner and the wall of the bore hole.

7. A method as in claim 6, wherein said pressing step comprises the steps of:

contacting rotary pressing means with said liner; and rotating said pressing means.

8. A method as in claim 6, wherein said pressing step further comprises the step of:

moving said pressing means axially of said liner and the wall of the bore hole to thereby press at least substantial portions of said liner against the wall of the bore hole.

9. A method for sealing the wall of a bore hole, the bore hole having a predetermined diameter, the method comprising the steps of:

forming a resilient liner substantially into a cylinder having a smaller diameter than the predetermined diameter;

applying a layer of mud to the exterior of said liner;

applying a layer of cement to said layer of mud;

inserting said liner into the bore hole;

allowing the liner to expand into contact with the wall of the bore hole whereby its diameter is increased to substantially the predetermined diameter; and pressing said liner against the wall of the bore hole.

10. A method as in claim 9 wherein said step of forming a liner comprises the steps of:

forming a liner of resilient sheet material into said cylinder wherein said resilient material is biased in a direction tending to enlarge the diameter of said cylinder; and retaining said liner in the form of said cylinder of smaller diameter.

11. A method as in claim 9, wherein said pressing step comprises the steps of:

contacting pressing means with said liner; and moving said pressing means circumferentially of said liner and the wall of the bore hole.

12. A method as in claim 11, wherein said pressing step comprises the steps of:

contacting rotary pressing means with said liner; and rotating said pressing means.

13. A method as in claim 11, wherein said pressing step further comprises the step of:

moving said pressing means axially of said liner and the wall of the bore hole to thereby press at least substantial portions of said liner against the wall of the bore hole.

14. A method as in claim 9, wherein said cement is a dry cement.

15. A liner for insertion into a bore hole comprising:

a resilient sheet adapted to be pressed against the wall of a bore hole; and a layer of mud applied to the surface of said sheet and a layer of dry cement applied to said layer of mud prior to insertion of said sheet into a bore hole.

16. A liner as in claim 15, wherein the bore hole has a predetermined diameter and circumference, and wherein:

said resilient sheet has at least one dimension at least as great as the predetermined circumference; and said sheet is pressed against the wall of the bore hole about the entire circumference thereof.

17. A liner as in claim 15, further comprising:

means for retaining said sheet in a substantially cylindrical configuration with a diameter smaller than the predetermined diameter prior to application of said sheet to the wall of the bore hole; and means for releasing said sheet to allow it to expand to the predetermined diameter.

18. Apparatus for lining a bore hole having a predetermined diameter, comprising:

an elongated member having a first end thereof adapted to be inserted into the bore hole;

a liner of resilient sheet material formed into a scroll having a smaller diameter than the predetermined diameter;

a squeegee coupled to said elongated member and located adjacent said first end for sealing the portion of said bore hole above said squeegee;

means associated with said elongated member for supporting said liner within the bore hole; and rotary means for pressing said liner into contact with the wall of the bore hole.

19. Apparatus for lining a bore hole, comprising:

an elongated member having a first end thereof adapted to be inserted into the bore hole;

an expandable liner adapted to be inserted into the bore hole;

means associated with said first end for supporting said liner within the bore hole;

rotary means including at least one element comprising a displaceable strip of resilient material having first and second ends, means for moving said second end toward and away from said first end to expand and retract said displaceable strip to press said liner into contact with the wall of the bore hole, and means for mounting said first end of said displaceable strip to said rotary means at a fixed position thereon; and means for driving said rotary means in rotation about an axis generally parallel to the axis of the bore hole.

20. Apparatus for lining a bore hole having a predetermined diameter, comprising:

an elongated member having a first end thereof adapted to be inserted into the bore hole;

a liner of resilient sheet material formed into a scroll having a smaller diameter than the predetermined diameter;

retaining means comprising a non-conductive line or cable encircling said liner and secured by releasable knot means for retaining said liner in a substantially cylindrical configuration with a diameter smaller than the diameter of the bore hole;

means associated with said elongated members for supporting said liner within the bore hole;

means for releasing said liner, thereby allowing said liner to expand into contact with the wall of the bore hole, said releasing means comprising release cable means having one end coupled with said releasable knot means, said cable means extending upwardly and out of said bore hole, wherein an upwardly exerted force on said release cable means causes said releasable knot means to release said retaining line or cable and thereby allow said liner to expand into contact with the wall of said bore hole; and rotary means for pressing said liner into contact with the wall of the bore hole.

21. Apparatus as in claim 20, wherein;

said elongated member comprises a second end; and means are associated with said second end of said elongated member for driving said elongated member and said rotary means in rotation.

22. Apparatus as in claim 21, wherein means are associated with said second end of said elongated member for axially reciprocating said rotary means within said hole.

23. Apparatus as in claim 20, wherein:

said retaining means comprises at least one fastener retaining said liner in said configuration; and said releasing means comprises means for rupturing said fastener.

24. Apparatus as in claim 23, wherein said rupturing means is an explosive.

25. Apparatus according to claim 20, wherein said retaining means comprises a plurality of non-conductive lines or cables encircling said liner at spaced apart locations, each such line or cable being secured by a corresponding releasable knot; and said knots being serially coupled to each other with one of said knots being coupled to said release cable.

26. Apparatus for lining a bore hole having a predetermined diameter, comprising:

an elongated member having a first end thereof adapted to be inserted into the bore hole;

a liner of resilient sheet material formed into a scroll having a smaller diameter than the predetermined diameter;

means associated with said first end for supporting said liner within the bore hole;

rotary means for pressing said liner into contact with the wall of the bore hole, said rotary means comprising:

at least one displaceable member having first and second ends for pressing said liner into contact with the wall of the bore hole, means for retracting said at least one displaceable member and for expanding said at least one displaceable member to press said liner into contact with the wall of the bore hole, means for mounting said first end of said at least one displaceable member at a fixed position on said rotary means, and means for moving said second end toward and away from said first end to expand and retract said at least one element; and means for driving said rotary means in rotation about an axis generally parallel to the axis of the bore hole.

27. Apparatus as in claim 26, wherein said means for moving said second end comprises a solenoid.

28. Apparatus as in claim 27, wherein said mens for moving said second end further comprises a weight biasing said at least one element into engagement with said liner.

29. Apparatus as in claim 26, wherein:

said elongated member comprises a second end; and means are associated with said second end of said elongated member for driving said elongated member and said rotary means in rotation.

30. Apparatus as in claim 26, further comprising means associated with said first end of said elongated member for blocking flow through the bore hole.

31. Apparatus as in claim 30, wherein said means for blocking flow comprises a sealing member having a diameter substantially equal to the diameter of the bore hole.

32. Apparatus as in claim 31, further comprising means associated with said flow blocking means for applying lubricating mud to said liner.

33. Apparatus as in claim 30, further comprising means associated with said flow blocking means for applying lubricating mud to said liner.

34. Apparatus as in claim 26, further comprising means for applying lubricating mud to said liner.

35. A liner for insertion into a bore hole having a wall with a predetermined diameter and circumference, comprising:

a resilient sheet having at least one dimension at least as great as the predetermined circumference of the bore hole wall and forming a substantially cylindrical surface;

said sheet further having outwardly bevelled portions at the axial ends of said cylindrical surface and being adapted to be pressed against the wall of the bore hole about the entire circumference thereof;

and a layer of mud applied to the surface of said sheet and a layer of cement applied to said layer of mud prior to insertion of said liner into a bore hole.

36. A liner as in claim 35, further comprising:

means for retaining said sheet in a substantially cylindrical configuration with a diameter smaller than the predetermined diameter prior to application of said sheet to the wall of the bore hole; and means for releasing said sheet to allow it to expand the predetermined diameter.

37. A method as in claim 35, wherein said cement is a dry cement.

38. A method for sealing the wall of a bore hole, the bore hole having a predetermined diameter, the method comprising the steps of:

forming a liner of resilient sheet material into a scroll having a smaller diameter than a predetermined diameter;

applying a layer of mud to the exterior surface of said scroll and applying a layer of cement to said layer of mud prior to inserting said scroll into the bore hole;

inserting said liner into the bore hole;

allowing said scroll to expand whereby its diameter is increased to substantially the predetermined diameter; and pressing said liner against the wall of the bore hole.

39. A method as in claim 38, wherein said cement is a dry cement.

* * * * *